US005303828A

United States Patent [19]

Paullin

[11] Patent Number: 5,303,828

[45] Date of Patent: Apr. 19, 1994

[54] SPORTS EQUIPMENT HOLDER

[76] Inventor: Lane A. Paullin, 1402 Edgewood Dr., Ashland, Ohio 44805

[21] Appl. No.: 85,834

[22] Filed: Jul. 6, 1993

[51] Int. Cl.[5] ..... A47F 7/00

[52] U.S. Cl. ..... 211/13; 211/14; 211/87

[58] Field of Search ..... 211/13, 14, 87, 60.1, 211/49.1; 248/310, 311.2, 309.1, 314

[56] References Cited

U.S. PATENT DOCUMENTS

| | | | |
|---|---|---|---|
| 1,742,069 | 12/1929 | Greenwald et al. | 248/310 X |
| 2,673,057 | 3/1954 | Morris | 248/311.2 |
| 3,180,605 | 4/1965 | Ewaskowitz | 248/311.2 X |
| 3,698,563 | 10/1972 | Gordon et al. . | |
| 3,869,137 | 3/1975 | Byrom . | |
| 4,227,710 | 10/1980 | Laub . | |
| 4,448,312 | 5/1984 | Schuman . | |
| 4,561,547 | 12/1985 | Estwanik . | |
| 4,936,467 | 6/1990 | Bobeczko . | |
| 5,190,257 | 3/1993 | Gradei et al. | 248/311.2 X |

*Primary Examiner*—Robert W. Gibson, Jr.
*Attorney, Agent, or Firm*—Renner, Otto, Boisselle & Sklar

[57] ABSTRACT

The present invention provides a new and advantageous device for storing athletic equipment, especially the equipment associated with the games of baseball and softball. The sports equipment holder of the present invention includes a pair of U-shaped brackets joined to form four upwardly pointing fingers which are spaced to hold baseballs or softballs stacked one on top of the other. A brace extends across and above the ends of one of the U-shaped brackets from which a pair of crossbars extend. The crossbars are spaced to engage the narrow end of baseball bats, at least one on each side of the brace. The distal ends of the brace crossbars curve upward to form hooks for hanging a glove, baseball shoes, batting gloves, batting doughnuts, or other such paraphernalia.

7 Claims, 2 Drawing Sheets

SPORTS EQUIPMENT HOLDER

FIELD OF THE INVENTION

The present invention relates to devices for holding sporting equipment and keeping it organized. Specifically, the present invention relates to a device for keeping baseball or softball equipment neatly stored and readily available when needed.

BACKGROUND OF THE INVENTION

Sporting equipment can create an undesirable mess if not kept neatly organized. Numerous prior art devices are known to facilitate the storage of sporting equipment, particularly baseballs, soft balls, bats, gloves and the other paraphernalia of the game of baseball. Among the prior art devices are those shown in the following U.S. Pat. Nos.: 3,698,563; 3,869,137; 4,227,710; 4,448,312; 4,561,547 and 4,936,467.

SUMMARY OF THE INVENTION

The present invention provides a new and advantageous device for storing athletic equipment, especially the equipment associated with the games of baseball and softball. The sports equipment holder of the present invention includes a pair of U-shaped brackets joined to form four upwardly pointing fingers which are spaced to hold baseballs or softballs stacked one on top of the other. A brace extends across and above the ends of one of the U-shaped brackets. A pair of crossbars extend transverse to the brace. The crossbars are spaced to engage the narrow end of baseball bats and can hold at least one bat on each side of the brace. The distal ends of the crossbars curve upward to form hooks for hanging a glove, baseball shoes, batting gloves, batting doughnuts, or other such paraphernalia.

These and other features of the present invention will be apparent to those skilled in the art from the following specification when read in light of the accompanying figure.

BRIEF DESCRIPTION OF THE FIGURES

The FIG. 1 shows the sports equipment holder of the present invention in a perspective view.

DESCRIPTION OF PREFERRED EMBODIMENT

Figure 1:
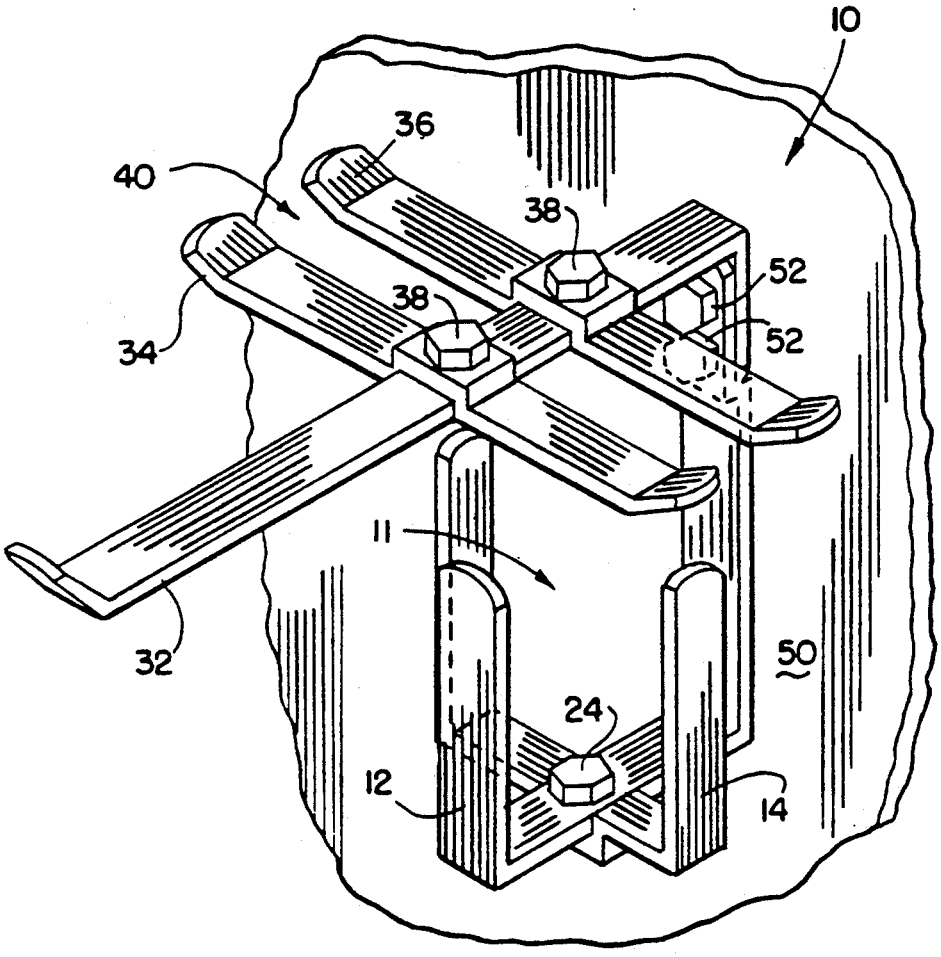
Figure 2:
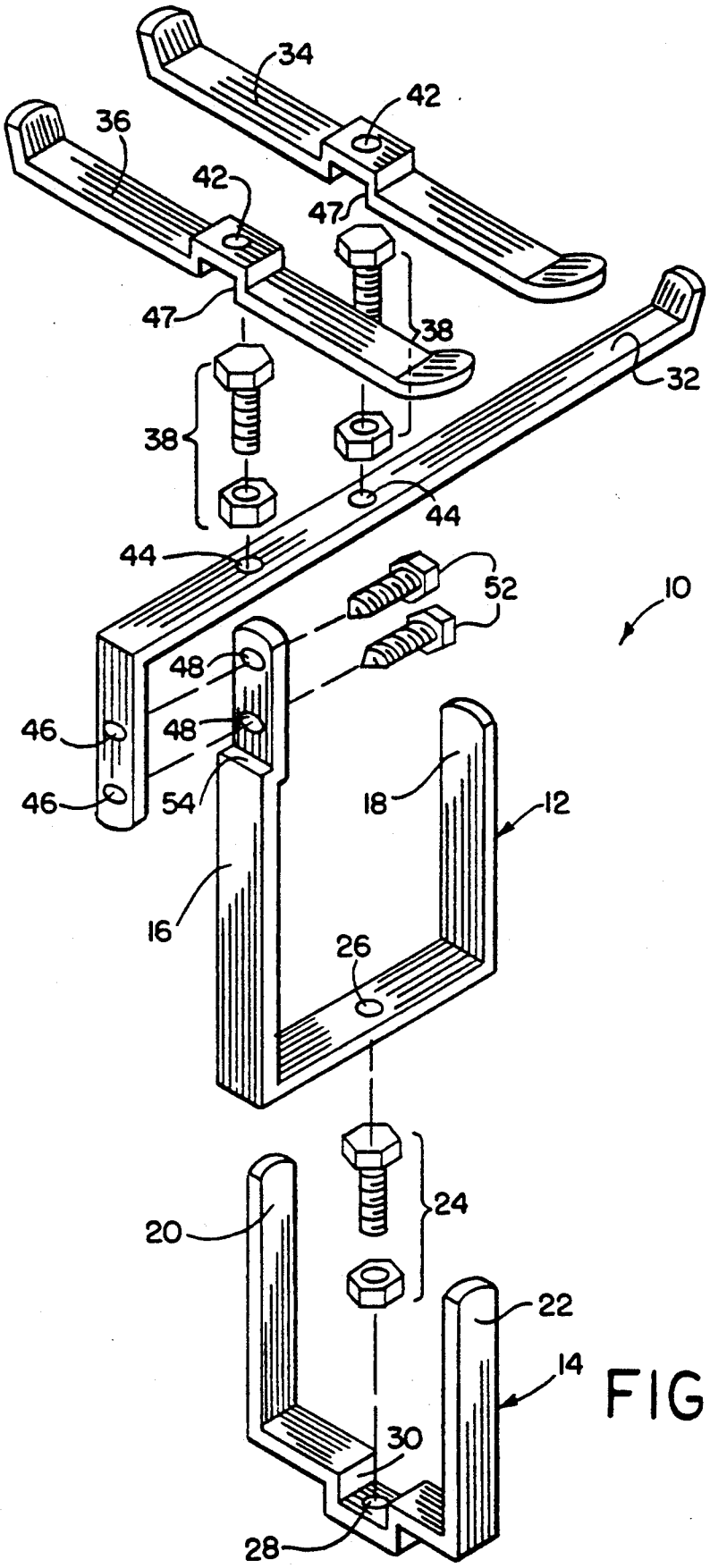
FIG. 2 is an exploded view of the parts comprising the sports equipment holder of FIG. 1.

The Figures show a sports equipment holder 10 constructed in accordance with the present invention. It includes a ball holder 11 formed from a pair of generally U-shaped brackets 12 and 14 formed of a suitable strap metal such as mild steel three quarters of an inch wide and 0.1875 inches thick. Of course other materials and other dimensions may be used so long as the functional aspects of the present invention are preserved.

The brackets 12 and 14 that form the ball holder 11 open upwardly and are joined at the midpoints of their bottoms. Together the two brackets provide four upwardly pointing fingers 16, 18, 20 and 22. The lengths of the fingers and the distance between them is selected so that a stack of baseballs or softballs can be retained inside the fingers. In a preferred embodiment, the finger length of about seven and one-eighth inches will accommodate three baseballs or two softballs. However, longer fingers would permit storage of more balls.

The connection between the two brackets is effected by a nut and bolt assembly 24 or other suitable fastener which passes through holes 26 and 28 through the brackets 12 and 14, respectively. The bracket 14 is formed with an offset 30 at its bottom which matches the width of the bracket 12. Once the nut and bolt assembly 24 is tightened, the sides of the offset 30 engage the sides of the bracket 12 to hold the two brackets in the desired relative position, i.e., with the four fingers 16–22 equally spaced around the stack of balls so that each finger is equidistant from adjacent fingers.

The sports equipment holder 10 also includes a bat rack 40. The bat rack 40 will hold at least four baseball bats and has hooks for holding additional equipment.

The bat rack 40 is formed by a brace 32 which extends across and above the ends of U-shaped bracket 12 and a pair of crossbars 34 and 36 which are joined at their midpoints to brace 32. The brace and crossbars are formed of the same material and have the same thickness and width as the U-shaped brackets 12 and 14. Other suitable strap metal may be used as well as other dimensions, provided the functional aspects of the invention are preserved. The crossbars 34 and 36 are spaced to engage the narrow ends of baseball bats. For purposes of this application baseball bats is meant to include all such bats including baseball, softball and plastic bats. The distal ends of the brace crossbars 34 and 36 curve upward to form hooks for hanging a glove, baseball shoes, batting gloves, batting doughnuts, or other such baseball paraphernalia. Additionally, the front end of the brace 32 is curved upward, also to form a hook.

The connections between the brace 32 and the crossbars 34 and 36 are effected by nut and bolt assemblies 38 or other suitable fasteners which pass through holes 42 in the crossbars 34 and 36 and holes 44 in the brace 32. The crossbars 34 and 36 are formed with offsets 47 which match the width of the brace 32. Once the nut and bolt assemblies 38 are tightened, the sides of the offsets 47 engage the sides of the brace 32 to hold the two crossbars in the desired relative position, i.e., generally parallel and spaced to engage the narrow ends of baseball bats.

The ball holder 11 and the bat rack 40 are connected to each other and attached to a supporting structure, such as a wall 50, by passing a bolting means, such as lag bolts 52, through holes 48 in U-shaped bracket 12 and holes 46 in brace 32 and then into the supporting structure to secure the equipment holder. Any bolting means known in the art will suffice to secure the equipment holder to the supporting structure. The end of the U-shaped bracket 12 is formed with an offset 54 which matches the thickness of the brace 32. Once the bolts 52 are in place, the bottom of the brace 32 engages the bottom of the offset 54 to hold the ball holder 11 and the bat rack 40 in the desired position to form the sports equipment holder 10.

While the invention has been explained in relation to a preferred embodiment, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A baseball equipment holder, comprising:

two U-shaped brackets joined at the midpoints of their bottoms to provide four upwardly pointing fingers that are equidistant from their adjacent fingers and form a space in which balls may be stored in a column wherein said balls are removed for use from the top of the column;

a generally horizontally extending brace;

two crossbars joined at their midpoints to said brace, said crossbars being spaced to engage the narrow end of a baseball bat, and said crossbars being of sufficient length so that at least one bat may be stored on each side of said brace; and means for connecting said brace to one of said U-shaped brackets and for positioning said brace to extend across the top of the column of balls.

2. The baseball equipment holder of claim 1, wherein said U-shaped brackets are proportioned to accommodate a stack of baseballs.

3. The baseball equipment holder of claim 1, wherein said U-shaped brackets are proportioned to accommodate a stack of softballs.

4. The baseball equipment holder of claim 1, wherein the front end of said brace and the distal ends of said crossbars are curved upwards to form hooks for holding additional equipment and paraphernalia of the game of baseball.

5. The baseball equipment holder of claim 1, wherein said means for connecting includes means for simultaneously connecting said brace to one of said U-shaped brackets and to a supporting structure.

6. The baseball holder of claim 1 wherein the brace is positioned above the uppermost ends of at least three of the four fingers by a distance at least as large as the diameter of the balls to be stored.

7. The baseball holder of claim 1 wherein the brace is positioned above the uppermost ends of at least three of the four fingers by a distance at least as large as the diameter of the balls to be stored; said U-shaped brackets being proportioned to accommodate a stack of softballs; the front end of said brace and the distal ends of said crossbars being curved upwards to form hooks for holding additional equipment and paraphernalia of the game of baseball; and said means for connecting includes means for simultaneously connecting said brace to one of said U-shaped brackets and to a supporting structure.

* * * * *